United States Patent [19]

Shimomura et al.

[11] Patent Number: 4,826,807

[45] Date of Patent: May 2, 1989

[54] HEAT-SENSITIVE RECORDING MATERIAL

[75] Inventors: Akihiro Shimomura; Kenji Ikeda, both of Shizuoka, Japan

[73] Assignee: Fuji Photo Co., Ltd., Kanagawa, Japan

[21] Appl. No.: 130,598

[22] Filed: Dec. 9, 1987

[30] Foreign Application Priority Data

Dec. 9, 1986 [JP] Japan ..... 61-293051

[51] Int. Cl.[4] ..... B41M 5/18

[52] U.S. Cl. ..... 503/226; 427/152; 428/913; 428/914; 503/200; 503/216

[58] Field of Search ..... 427/150–152; 428/913, 914, 195; 503/200, 226, 209, 214, 216–218

[56] References Cited

FOREIGN PATENT DOCUMENTS 0146794 11/1981 Japan ..... 503/226

1209192 9/1986 Japan ..... 503/226

*Primary Examiner*—Bruce H. Hess

*Attorney, Agent, or Firm*—Sughrue, Mion, Zinn, Macpeak & Seas

[57] ABSTRACT

A heat-sensitive recording material is disclosed, which comprises a support having thereon, in sequence, a heat-sensitive color-forming layer containing a colorless or slightly colored electron-donating dye precursor and an electron-accepting compound capable of reacting with the electron-donating dye precursor to form color, and a protective layer containing an alkali salt of an amidified copolymer of styrene and maleic acid.

16 Claims, No Drawings

HEAT-SENSITIVE RECORDING MATERIAL

FIELD OF THE INVENTION

The present invention relates to a heat-sensitive recording material, and more particularly relates to a heat-sensitive recording material having reduced sticking properties and excellent water-resistant properties.

BACKGROUND OF THE INVENTION

A so-called two component type heat-sensitive recording material using a color-forming reaction of a colorless or slightly colored electron-donating dye precursor with an electron-accepting compound is disclosed in Japanese Patent Publication Nos. 14039/70 and 4160/68. This type of two-component color-forming heat-sensitive recording material is prepared by dispersing a colorless or slightly colored electron-donating dye precursor and an electron-accepting compound into a fine particle state, mixing a binder therewith so that the electron-donating dye precursor and the electron-accepting compound are separated, and coating the resulting mixture on a support. Upon heating, these heat-sensitive color-forming compounds melt, contact each other, and thus participate in a color-forming reaction whereby recording takes place.

Such two-component type color-forming heat-sensitive recording materials are advantageous in that: (1) primary coloration takes place and, therefore, color development is unnecessary; (2) paper quality is similar to paper used for ccnventional types of recording; (3) handling is easy; (4) color density of the resulting images is high; and (5) upon color formation, various hues can be obtained. Accordingly, this type of recording material is very attractive from an economic standpoint. Therefore, this type of two-component color-forming heat-sensitive recording material was become widely used in practice recently, particularly in the fields of facsimile transmissions, recorders and printers. With such increasingly wide usage in the field of facsimile transmissions, the recording rate has also increased significantly in recent years. Thus, in view of this tendency to increase facsimile recording rates for practical and economical reasons, a strong demand has arisen for heat-sensitive recording materials which have a short pulse, that is, the ability to undergo color formation with a low energy input. In other words, improvement of heat reactivity of the recording materials has long been desired.

On the other hand, this type of heat-sensitive recording material has a defect in that due to primary coloration, a reaction between an electron-donating dye precursor and an electron-accepting compound takes place not only upon heating, but also upon contact with certain solvents and the like.

This is because all components of the heat-sensitive recording materials are organic substances and have high solubility in solvents such as ethanolamines, ethylene glycols, etc., whereby a reaction takes place in the solvent. Therefore, when such heat-sensitive recording materials are brought into contact with stationeries containing solvents such as water-soluble ink pens (felt pens), oil-soluble ink pens (felt pens) or fluorescent pens, diazo developing solutions, bonds, pastes, etc., white areas of the recording material become colored and printed areas disappear, thereby remarkably reducing the commercial value of the material.

It has hitherto been suggested that a solvent-resistant protective layer can be provide on a heat-sensitive color-forming layer to eliminate the above problems, as disclosed in Japanese Patent Publication No. 27880/69 and Japanese Patent Application (OPI) Nos. 30437/73, 31958/73 and 111729/84 (corresponding to U.S. Pat. No. 4,583,103) (the term "OPI" as used herein refers to a "published unexamined Japanese patent application").

Various binders used for such a protective layer are known. Heat-sensitive recording materials using alkali salts of a copolymer of styrene and maleic acid and alkali salts of a copolymer of styrene and maleic acid ester as binders for a protective layer tend to have reduced coloration on white (background) areas and a reduced occurrence of image disappearance on printed areas when they are brought into contact with a fluorescent pen containing solvents such as triethanolamine, triethylene glycol, etc. However, this type of heat-sensitive recording material is generally of poor water resistivity, and has certain undesirable defects, e.g., when a heat-sensitive recording paper comes into contact with water and is then placed in contact with the other recording paper, they may be adhered. Thus, when printing takes place using a thermal head, sticking occurs. Hence, still further improvements in protective layers and, in particular, binders therefor, for this type of heat-sensitive recording material are necessary to overcome these types of problems.

SUMMARY OF THE INVENTION

An object of the present invention is to provide a heat-sensitive recording material having excellent water resistivity using alkali salts of copolymers of styrene and maleic acid as a binder for a protective layer.

This and other objects of the present invention can be attained by a heat-sensitive recording material comprising a support having thereon a heat-sensitive color-forming layer containing a colorless or slightly colored electron-donating dye precursor and an electron-accepting compound capable of reacting with the electron-donating dye precursor to form color and a protective layer, provided on the color-forming layer, containing an alkali salt of an amidified copolymer of styrene and maleic acid.

DETAILED DESCRIPTION OF THE INVENTION

The heat-sensitive recording material of the present invention is substantially composed of a support (preferably a neutral paper) having thereon, in sequence, a heat-sensitive color-forming layer and a protective layer.

One aspect of the present invention is that alkali salts such as sodium salt, potassium salt or ammonium salt of amidified copolymers of styrene and maleic acid having an amidifying degree (the number of the carboxyl group amidified in the molecule) of about 30% or more are preferably used alone or in combination as a binder for a protective layer provided on a heat-sensitive color-forming layer. The salts of the copolymer preferably have a molecular weight of from about 30,000 to about 250,000, more preferably from 80,000 to 150,000.

The preferred amount of the alkali salts of an amidified copolymer of styrene and maleic acid used in the present invention is 0.1 to 5 $g/m^2$, more preferably 0.5 to 2 $g/m^2$.

Alkali salts of copolymers of styrene and maleic acid or alkali salts of copolymers of styrene and maleic acid ester have conventionally been used in protective layers of heat-sensitive recording papers as described above, but water-resistant properties are rather poor under severe conditions and sticking sometimes takes place depending upon the kind of thermal head employed.

However, applicants have unexpectedly found that both water resistance and reduction of sticking are greatly improved by using alkali salts of amidified copolymers of styrene and maleic acid in accordance with the present invention.

Binders used in a protective layer of the present invention may comprise only the above-described salts of the amidified copolymers, and also may be in admixture with other salts of copolymers of styrene and maleic acid and with other polymers. Specific examples of suitable other polymers include polyvinyl alcohol, methyl cellulose, starches, carboxymethyl cellulose, a copolymer of diisobutyrene and maleic acid, polyamide resins, polyacrylamide resins, gelatin, casein, gum arabic, styrene and butadiene rubber latex, acrylonitrile and butadiene rubber latex and vinyl acetate emulsions.

When the binder of the present invention is used with other polymers, it is necessary that salts of the above amidified copolymer of styrene and maleic acid should be present in an amount of at least about 30% by weight.

The above components of the protective layer are dispersed or dissolved using a solvent such as water, coated on a heat-sensitive color-forming layer and dried to provide a protective layer.

In accordance with the present invention, a protective layer and a heat-sensitive color-forming layer may be coated separately or simultaneously.

The heat-sensitive color-forming layer of the present invention is prepared by coating a dispersion of a colorless or slightly colored electron-donating dye precursor (hereinafter referred to as a "color former") and an electron-accepting compound (hereinafter referred to as a "developer") dispersed in a binder, with known additives, if necessary.

The color formers used in the present invention include triarylmethane compounds, diphenylmethane compounds, xanthene compounds, thiazine compounds and spiropyran compounds. Specific examples thereof include triarylmethane compounds such as 3,3-bis(p-dimethylaminophenyl)-6-dimethylaminophthalide (that is, crystal violet lactone), 3,3-bis(p-dimethylaminophenyl)phthalide, 3-(p-dimethylaminophenyl)-3-(1,3-dimethylindol-3-yl)phthalide or 3-(p-dimethylaminophenyl)-3-(2-methylindol-3-yl)phthalide, diphenylmethane compounds such as 4,4'-bisdimethylaminobenzhydrin benzyl ether, N-halophenylleucoauramine or N-2,4,5-trichlorophenyl leucoauramine, xanthene compounds such as rhodamine-B-anilinolactam, rhodamine(p-nitroanilino)lactam, rhodamine-B-(p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexyl methylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran or 2-anilino-3-chloro-6-N-ethyl-N-isoamylaminofluoran, thiazine compounds such as benzoyl leucomethylene blue and spiro compounds such as 3-methyl-spirodinaphthopyran, 3-ethyl-spirodinaphthopyran, 3,3'-dichloro-spirodinaphthopyran, 3-benzylspirodinaphthopyran, 3-methylnaphtho(3-methoxybenzo)spiropyran or 3-propyl-spirodibenzopyran. These compounds can be used alone or in combination.

The color former is preferably used in an amount of 0.05 to 2 g/m$^2$, more preferably 0.2 to 1 g/m$^2$.

The developers of the present invention include phenol compounds, organic acids and the metal salts thereof, oxybenzoate and the like. Particularly, phenol compounds are preferred, since a small amount thereof is added to the heat-sensitive layer. Among phenol compounds, bisphenol compounds are more preferred.

Oxybenzoate is also preferred due to its high density of the printed letters.

The developer compounds disclosed, for example, in Japanese Patent Publication Nos. 14039/70 and 29830/76 are suitable in the present invention. Specific examples thereof include 4-tertiarybutylphenol, 4-phenylphenol, 4-hydroxydiphenoxide, α-naphthol, β-naphthol, methyl-4-hydroxybenzoate, 2,2'-dihydroxybiphenyl, 2,2-bis(4-hydroxyphenyl)propane (bisphenol A), 4,4'-isopropylidene-bis(2-methylphenol), 1,1-bis(3-chloro-4-hydroxyphenyl)cyclohexane, 1,1-bis(3-chloro-4-hydroxyphenyl)-2-ethylbutane, 4,4'-secondary-isobutylidenediphenol, 1,1-bis(4-hydroxyphenyl)cyclohexane, 1,4-bis(4'-hydroxycumyl)benzene, benzyl 4-hydroxybenzoate, m-chlorobenzyl 4-hydroxybenzoate, β-phenethyl 4-hydroxybenzoate, 4-hydroxy-2',4'-dimethylphenylsulfon, 1-t-butyl-4-p-hydroxyphenylsulfonyloxybenzene, 4-N-benzylsulfamoyl phenol, β-phenoxyethyl 2,4-dihydroxybenzoate and benzyl 2,4-dihydroxy-6-methylbenzoate.

The developer is preferably used in an amount of 0.1 to 6 g/m$^2$, more preferably 0.4 to 3 g/m$^2$.

Sensitizing agents can be incorporated in a heat-sensitive color-forming layer with the color formers and developers to improve heat responsivity.

Preferred sensitizing agents are organic compounds having a melting point of from about 70° to about 150° C. and having good compatibility with a color former or a developer. Specific examples include compounds represented by the following formulae (I) to (VI):

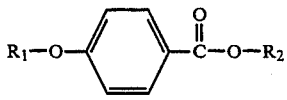

(I)

-continued

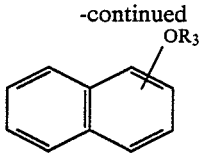

(II)

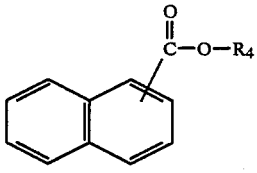

(III)

$R_5NHCONH_2$ (IV)

$R_6CONH—R_7$ (V)

wherein $R_1$ to $R_4$, which may be the same or different, each represents a phenyl group, each of which may be substituted with a lower alkyl group, a halogen atom, a hydroxy group or an alkoxy group, $R_5$ and $R_6$, which may be the same or different, each represents an alkyl group having from 12 to 24 carbon atoms, and $R_7$ represents a hydrogen atom or a phenyl group.

When a phenyl group or a benzyl group represented by $R_1$ to $R_4$ in formulae (I) to (III) is substituted with a lower alkyl group, the number of carbon atoms in the lower alkyl group is from 1 to 8, preferably from 1 to 3. When the phenyl group or benzyl group is substituted with a halogen atom, a preferred halogen atom is a chlorine atom or a fluorine atom. Formula (VI) is shown below:

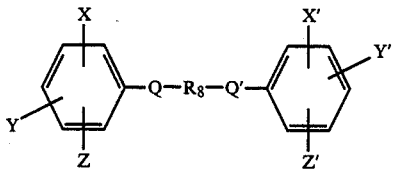

(VI)

wherein $R_8$ represents a divalent group, and preferably represents an alkylene group, an alkylene group having an ether bond, an alkylene group having a carbonyl group, an alkylene group having a halogen atom, and an alkylene group having an unsaturated bond, and more preferably represents an alkylene group and an alkylene group having an ether bond. X, Y, Z, X', Y' and Z' may be the same or different and each represents a hydrogen atom, an alkyl group, a lower alkoxy group, a lower aralkyl group, a halogen atom, an alkyloxycarbonyl group and an aralkyloxycarbonyl group. Q and Q', which may be the same or different, each represents an oxygen atom or a sulfur atom.

The compounds represented by formulae (I) to (VI) have a melting point of preferably from 70° to 150° C., more preferably from 80° to 130° C.

Specific examples of sensitizing agents include benzyl p-benzyloxybenzoate, β-naphthylbenzyl ether, stearic acid amide, palmitic acid amide, N-phenyl stearic acid amide, N-stearyl urea, phenyl β-naphthoate, phenyl 1-hydroxy-2-naphthoate, β-naphthol(p-chloprobenzyl) ether, β-naphthol(p-methylbenzyl) ether, α-naphthylbenzyl ether, 1,4-butanediol-p-methylphenyl ether, 1,4-propanediol-p-methylphenyl ether, 1,4-butanediol-p-isopropylphenyl ether, 1,4-butanediol-p-t-octylphenyl ether, 2-phenoxy-1-p-tolyloxyethane, 1-phenoxy-2-(4-ethylphenoxy)ethane, 1-phenoxy-2-(4-chlorophenoxy)ethane, 1,4-butanediol phenyl ether and 1,2-bis(4-methoxyphenylthio)ethane.

The sensitizing agents may be used alone or in combination, and are used in an amount of from about 10 to about 200 wt %, preferably from 20 to 150 wt %, based on the developer to obtain sufficient heat responsivity.

In the present invention, a heat-sensitive color-forming layer is prepared by dispersing the above-described color formers, developers and (if necessary) sensitizing agents with a binder composed of water-soluble high molecular weight compounds using a solvent such as water, coating the resulting solution on a support such as a paper, a plastic film or a synthetic paper and drying the resulting material.

Water-soluble high molecular weight compounds which may suitably be used as a binder include polyvinyl alcohol, hydroxyethyl cellulose, hydroxypropyl cellulose, a copolymer of ethylene and maleic anhydride, a copolymer of styrene and maleic anhydride, a copolymer of isobutylene and maleic anhydride, polyacrylic acid, polyacrylic acid amide, starch derivatives, casein, gelatin, carboxymethyl cellulose and methyl cellulose.

Further, waterproofing agents such as a gel agent or a crosslinking agent and emulsions of hydrophobic polymers such as styrene and butadiene rubber latex or an acrylic resin emulsion can be added to the above water-soluble high molecular weight binders for providing water-resistant properties.

In addition, various other additives can be included in the heat-sesitive color-forming layer of the present invention.

Examples of such additives include inorganic pigments and waxes to prevent the recording head from being stained during recording, and fatty acids and metal soaps to increase releasing properties between the recording material and a head.

Examples of pigments include kaolin, calcined kaolin, talc, agalmatolite, diatom earth, calcium carbonate, aluminum hydroxide, magnesium hydroxide, magnesium carbonate, titanium oxide, barium carbonate, urea-formalin filler and cellulose filler.

Suitable waxes include paraffin wax, carnauba wax, microcrystalline wax, polyethylene wax and higher fatty acid esters and the like.

Suitable metal soaps include higher fatty acid polyvalent metal salts such as zinc stearate, aluminum stearate, calcium stearate and zinc oleate and the like.

In the present invention, the above-described heat-sensitive color-forming layer is provided on a support, and then the above-described protective layer is provided thereon to obtain a heat-sensitive recording material.

Further, in the present invention waterproofing agents such as pigments, metal soaps or waxes may be added to the above-described protective layer also to improve matching properties of a thermal head upon printing and to improve water resistivity of the protective layer.

Pigments are used in an amount of from about 0.5 to about 4 times, preferably from 0.8 to 3.5 times, based on the total weight of the above polymers. When the additive amount is less than the above range, head matching properties cannot be improved. When the additive amount is more than the above range, sensitivities largely decrease, thereby reducing the commercial value of the materials. Examples of pigments for the protective layer include zinc oxide, calcium carbonate, barium sulfate, titanium oxide, lithopone, talc, agalmatolite, kaolin, aluminum hydroxide, silica, amorphous silica and colloidal silica and the like.

Examples of metal soaps for the protective layer include metal salts of higher fatty acids such as emulsions of zinc stearate, calcium stearate or aluminum stearate, and zinc stearate is most preferred. The additive amount thereof is preferably from about 0.5 to about 20 wt %, more preferably from 1 to 10 wt %, based on the total weight of the protective layer.

Examples of waxes for the protective layer include emulsions of paraffin wax, microcrystalline wax, carnauba wax, methylolaeroamide, stearic acid amide, polyethylene wax and polystyrene wax. The additive amount is preferably from about 1 to about 20 wt %, more preferably from 1 to 10 wt %, based on the total weight of the protective layer.

Surface active agents may also be added to provide a uniform protective layer upon coating a protective layer onto a heat-sensitive color-forming layer. Suitable surface active agents include surface active agents of alkali metal salts of sulfosuccinic acid type and fluorine-containing surface active agents. Specific examples thereof include sodium salts or ammonium salts of di(2-ethylhexyl)sulfosuccinic acid and di(n-hexyl)sulfosuccinic acid and almost all anionic surface active agents are effective.

The present invention will be illustrated in more detail by the following examples, but should not be construed as being limited thereby in any manner. Unless otherwise indicated, all parts, percents, ratios and the like are by weight.

EXAMPLES 1 AND 2

20 g of each of crystal violet lactone, benzyl parahydroxybenzoate, stearic acid amide and 1,1,3-tris(2-methyl-4-hydroxy-5-tert-butylphenyl)butane were separately dispersed with 100 g of an aqueous solution of 5% polyvinyl alcohol ("PVA 105", manufactured by Kuraray Co., Ltd.) in a ball mill for one day and one night to make four dispersions, each having a volume average particle diameter of 3 μm or less.

80 g of a pigment were dispersed with 160 g of a 0.5% aqueous solution of sodium hexametaphosphate by means of a homogenizer. 50 g of the dispersion containing crystal violet lactone, 10 g of the dispersion of benzyl parahydroxybenzoate, 5 g of the dispersion of stearic acid amide, 2 g of the dispersion of 1,1,3-tris(2-methyl-4-hydroxy-5-tert-butylphenyl)butane and 22 g of the dispersion of a pigment were mixed together, and 3 g of an emulsion of 21% zinc stearate and 5 g of a 2% aqueous solution of sodium di(2-ethylhexyl)sulfosuccinate were added thereto to obtain a coating solution. The resulting coating solution was coated on a high quality paper having weighing capacity of 50 g/m$^2$ by a wire bar so that the dry amount was 5 g/m$^2$, and dried by an oven at 50° C. to obtain a heat-sensitive color-forming layer.

15 g of a dispersion (the dispersion was prepared in the same manner as above) of kaolin ("Kaobright", a trade name, manufactured by Georgia Pacific Co., Ltd.), 4 g of an emulsion of 21% zinc stearate and 1 g of a 2% aqueous solution of sodium di(2-ethylhexyl)sulfosuccinate were mixed with 100 g of a 5% aqueous solution of the polymers shown in Table 1 to prepare a coating solution. The thus-obtained coating solution was coated on the above-described heat-sensitive color-forming layer by a wire bar so that the dry amount was 2 g/m$^2$, dried by an oven at 50° C. and thereafter pressed by a pressing apparatus equipped with a roll plated with hard chromium and a roll made of hard rubber (Shore hardness: 80) to obtain a heat-sensitive recording paper.

COMPARATIVE EXAMPLES 1 AND 2

A heat-sensitive color-forming layer was prepared and coated in the same manner as in the above examples, and a protective layer was also prepared and coated as in the above examples except that the binders used for the protective layer are those as shown in Table 1, to obtain heat-sensitive recording papers.

A test of water resistivity of the thus-obtained papers was done in the following manner.

0.5 μl of water were added drop by drop onto a surface of the above heat-sensitive recording papers, a high quality paper was placed thereon, dried by blown air for 1 hour, and then peeled off in order to measure the adhesive strength between the recording paper and the base paper. Papers having high water resistivity do not adhere.

A: A recording paper show no adherence

B: A recording paper and a base paper adhere, but the recording paper easily peels off from the base paper.

C: A recording paper and a base paper adhere firmly. The heat-sensitive paper or the base paper is damaged upon peeling off, and is not practically usable.

The results of these evaluations are shown in Table 1.

Sticking of a thermal head was evaluated in the following manner.

Using a facsimile apparatus A (UF 920 manufactured by Matsushita Electric Industrial Co., Ltd.), checkerwise printing was done with 50% black degree, and sticking sounds were checked upon color forming.

A: Sticking sounds were hardly heard. Normal color formation occurred.

B: Sticking sounds were heard, but normal color formation occurred.

C: Sticking sounds were heard, and color formation was incomplete, and there was noncolor-formed area within the color-formed area.

TABLE 1

| Polymers to Be Used in Protective Layer | | | | | |
|---|---|---|---|---|---|
| Example No. | Polymers | Molecular Weight | Neutralizing Substance (alkali salt) | Sticking | Water Resistivity |
| Example 1 | Amidified copolymer of styrene and maleic acid *1 | 50,000 | Ammonium | A | A |
| Example 2 | Amidified copolymer of styrene and maleic acid *2 | 220,000 | Ammonium | A | A |
| Comparative Example 1 | Half ester of copolymer of styrene and maleic acid *3 | 68,000 | Ammonium | C | A |
| Comparative | Half ester of copolymer | 74,000 | Ammonium | B | C |

TABLE 1-continued

| Polymers to Be Used in Protective Layer | | | | | |
|---|---|---|---|---|---|
| Example No. | Polymers | Molecular Weight | Neutralizing Substance (alkali salt) | Sticking | Water Resistivity |
| Example 2 | of styrene and maleic acid *4 | | | | |

Note

*1: 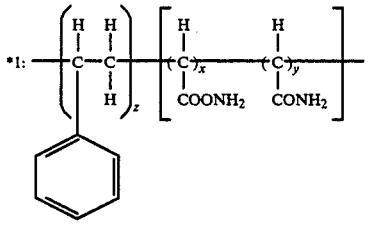

x:y:z = 7:3:10
The positions to be amidified are random.
*2: Same as the above formula *1 except that the molecular weight is changed as shown in Table 1.

*3: 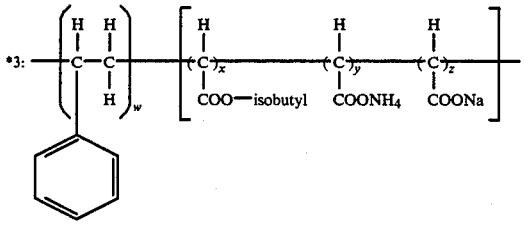

w:x:y:z = 10:4:4.8:1.2
The positions to be amidified are random.
*4: Same as the above formula *3 except that the ratio of w:x:y:z is 10:2:8:0 and the molecular weight is changed as shown in Table 1.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon, in sequence, a heat-sensitive color-forming layer containing a colorless or slightly colored electron-donating dye precursor and an electron-accepting compound capable of reacting with said electron-donating dye precursor to form color, and a protective layer containing an alkali salt of an amidifed copolymer of styrene and maleic acid, said protective layer being provided on said color former layer.

2. A heat-sensitive recording material as in claim 1, wherein said alkali salt is a sodium salt, a potassium salt, or an ammonium salt.

3. A heat-sensitive recording material as in claim 1, wherein said amidified copolymer of styrene and maleic acid has an amidifying degree of at least about 30%.

4. A heat-sensitive recording material as in claim 1, wherein the salt of the amidified copolymer has a molecular weight of from about 30,000 to about 250,000.

5. A heat-sensitive recording material as in claim 4, wherein said molecular weight is from 80,000 to 150,000.

6. A heat-sensitive recording material as in claim 1, wherein said protective layer comprises at least two alkali salts of an amidified copolymer of styrene and maleic acid.

7. A heat-sensitive recording material as in claim 6, wherein said protective layer further comprises at least one other polymer or copolymer.

8. A heat-sensitive recording material as in claim 1, wherein said protective layer further comprises at least one other polymer or copolymer.

9. A heat-sensitive recording material as in claim 8, wherein said salt of an amidified copolymer of styrene and maleic acid is present in an amount of at least about 30% by weight.

10. A heat-sensitive recording material as in claim 1, wherein said electron-donating dye precursor is selected from the group consisting of triarylmethane compounds, diphenylmethane compounds, xanthene compounds, thiazine compounds, and spiropyran compounds.

11. A heat-sensitive recording material as in claim 1, wherein said electron-accepting compound is selected from the group consisting of phenol compounds, organic acids and metal salts thereof, and oxybenzoate.

12. A heat-sensitive recording material as in claim 1, wherein said color-forming layer further comprises a sensitizing agent.

13. A heat-sensitive recording material as in claim 1, wherein said color-forming layer contains a binder composed of water-soluble high molecular weight compounds.

14. A heat-sensitive recording material as in claim 1, wherein said color-forming layer further contains one or more additives selected from the group consisting of waterproofing agents, inorganic pigments, waxes and metal soaps.

15. A heat-sensitive recording material as in claim 1, wherein said protective layer further comprises one or more additives selected from the group consisting of waterproofing agents, pigments, metal soaps and waxes.

16. A heat-sensitive recording material as in claim 1, wherein said protective layer further comprises a surface active agent.

* * * * *